US006246427B1

(12) United States Patent
Sogabe et al.

(10) Patent No.: US 6,246,427 B1
(45) Date of Patent: Jun. 12, 2001

(54) THERMAL TRANSFER IMAGE FORMING METHOD, AND COMBINATION OF THERMAL TRANSFER MEMBERS USED THEREIN

(75) Inventors: Jun Sogabe; Yuuichi Miyakusa, both of Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/574,370

(22) Filed: May 19, 2000

(30) Foreign Application Priority Data

May 21, 1999 (JP) ..... 11-141983

(51) Int. Cl.[7] ..... B41J 2/325; B41M 5/40; B41M 5/26; B41M 5/34

(52) U.S. Cl. ..... 347/172; 347/171; 347/217

(58) Field of Search ..... 347/171, 172, 347/174, 176, 217

(56) References Cited

FOREIGN PATENT DOCUMENTS

0795421 * 9/1997 (EP) .
11-151869 * 6/1999 (JP) .

* cited by examiner

*Primary Examiner*—Huan Tran
(74) *Attorney, Agent, or Firm*—Fish & Neave

(57) ABSTRACT

A thermal transfer image forming method comprising the steps of: using a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate; first conducting a thermal transfer using the preprint ribbon onto a receptor to form a preprint image whose topmost layer is composed of the first ink layer; and subsequently conducting a thermal transfer using the ink ribbon onto the preprint image to form an ink image, wherein the first ink layer of the preprint ribbon and the adhesive layer of the ink ribbon comprise the same kind of material as respective main components.

6 Claims, No Drawings

THERMAL TRANSFER IMAGE FORMING METHOD, AND COMBINATION OF THERMAL TRANSFER MEMBERS USED THEREIN

BACKGROUND OF THE INVENTION

The present invention relates to a thermal transfer image forming method used in a word processor, a facsimile or the like, and a combination of thermal transfer members which is used therein. More particularly, the present invention relates to a thermal transfer image forming method for forming an image having high fastness on various media by thermal transfer, the media including high quality paper sheets (paper sheets having a high surface smoothness), plastic films such as polyethylene terephthalate film, polypropylene film and vinyl chloride based resin films, and photographs; and a combination of thermal transfer members which is used therein.

For the purpose of forming images having high fastness on various receptors, a method has hitherto been adopted wherein fixing ability of an image to a receptor is improved by using an ink ribbon having, on its substrate, a color ink layer and an adhesive layer from the substrate side and making the adhesive layer of the ink ribbon of the same type of material as the material constituting the receptor. In order to realize an image having high fastness in this case, it is necessary to use, for the adhesive layer, a material having strong adhesion to the receptor. As the material having strong adhesion to the receptor, a resin having a high molecular weight or a like material needs to be selected and used. For this purpose, it is necessary to set a printing energy upon thermal transfer to a high value. This results in a problem that upon the thermal transfer the flatness of the color ink layer is damaged, causing a decrease in the density and chroma or saturation of the image. Particularly in the case of an ink ribbon, for forming a gloss image, having a metal deposition layer as its color layer, damage of the flatness of the color layer results in a problem that glossy impression is lost. Thus, in order to obtain an image having high quality and high fastness, it is necessary that ink ribbons in the prior art cope with each of diversified receptors.

Particularly in order to form a color image, it is in general necessary to prepare 3 kinds of ink ribbons (yellow, magenta and cyan ink ribbons) or 4 kinds of ink ribbons (yellow, magenta, cyan and black ink ribbons) having the above-mentioned structure. However, in order to obtain a color image having high fastness, adhesive layers of these ink ribbons need to be changed whenever the kinds of receptors change. For example, in the case that the above-mentioned 4 kinds of ink ribbons are used and 3 kinds of receptors, e.g., polyethylene terephthalate film (PET film), polypropylene film (PP film), and high quality paper sheets, are used, it is necessary that the number of kinds (N1) of the adhesive layers is 3. Therefore, in the case that the number of kinds (N2) of the ink ribbons (that is, color ink layers) is 4, 3 kinds of adhesive layers become necessary for each of the 4 kinds of color ink layers. After all, the number of kinds of necessary ink ribbons is $12=N1\times N2$. As described above, in order to form images having high fastness on various receptors according to the prior art, many kinds of ink ribbons are unavoidably prepared, resulting in a rise in costs.

In the light of the above-mentioned problems in the prior art, an object of the present invention is to provide a thermal transfer image forming method which makes it possible to easily cope with even an increased kinds of receptors due to diversification of receptors and to make the number of kinds of ink ribbons as small as possible, and to form images which are excellent in fastness; and a combination of thermal transfer members which is used therein.

Another object of the present invention is to provide a thermal transfer image forming method which makes it possible to reduce, as much as possible, restrictions originating from a demand of ensuring the fixing ability of an image to a receptor upon designing an ink layer of an ink ribbon; and a combination of thermal transfer members which is used therein.

These and other objects of the present invention will become apparent from the description hereinafter.

SUMMARY OF THE INVENTION

In a first aspect of the present invention there is provided a thermal transfer image forming method comprising the steps of:

using a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate;

first conducting a thermal transfer using the preprint ribbon onto a receptor to form a preprint image whose topmost layer is composed of the first ink layer; and subsequently conducting a thermal transfer using the ink ribbon onto the preprint image to form an ink image, wherein the first ink layer of the preprint ribbon and the adhesive layer of the ink ribbon comprise the same kind of material as respective main components.

In a second aspect of the present invention there is provided a thermal transfer image forming method comprising the steps of:

using a preprint ribbon comprising, on its substrate, at least a first ink layer and a second ink layer in this order from the side of the substrate, and plural ink ribbons each comprising, on its substrate, at least a color ink layer and an adhesive layer in this order from the side of the substrate, the color ink layers of the plural ink ribbons being different in color from each other;

first conducting a thermal transfer using the preprint ribbon onto a receptor to form a preprint image whose topmost layer is composed of the first ink layer; and subsequently conducting a thermal transfer using the plural ink ribbons onto the preprint image to form a color ink image, wherein the first ink layer of the preprint ribbon and the adhesive layer of each of the plural ink ribbons comprise the same kind of material as respective main components.

According to an embodiment of the first aspect of the present invention, the same kind of material used as the main components of the first ink layer of the preprint ribbon and the adhesive layer of the ink ribbon comprises at least one selected from the group consisting of a ketone resin, a petroleum resin, a rosin resin, a styrene resin and a polyamide resin, each of which has a glass transition point of 60° C. or higher, and polyethylene wax having a melting point of 100° C. or higher.

According to an embodiment of the second aspect of the present invention, the same kind of material used as the main components of the first ink layer of the preprint ribbon and the adhesive layer of each of the plural ink ribbons comprises at least one selected from the group consisting of a ketone resin, a petroleum resin, a rosin resin, a styrene resin and a polyamide resin, each of which has a glass transition point of 60° C. or higher, and polyethylene wax having a melting point of 100° C. or higher.

In a third aspect of the present invention there is provided a combination of thermal transfer members comprising a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate, wherein the first ink layer of the preprint ribbon and the adhesive layer of the ink ribbon comprise the same kind of material as respective main components.

In a fourth aspect of the present invention there is provided a combination of thermal transfer members comprising a preprint ribbon comprising, on its substrate, at least a first ink layer and a second ink layer in this order from the side of the substrate, and plural ink ribbon each comprising, on its substrate, at least a color ink layer and an adhesive layer in this order from the side of the substrate, the color ink layers of the plural ink ribbons being different in color from each other, wherein the first ink layer of the preprint ribbon and the adhesive layer of each of the plural ink ribbons comprise the same kind of material as respective main components.

DETAILED DESCRIPTION

In the present invention, there are used a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate. First, using the preprint ribbon, a thermal transfer is conducted onto a receptor to form a preprint image whose topmost layer is composed of the first ink layer. Subsequently using the ink ribbon, a thermal transfer is conducted onto the preprint image to form an ink image. The same kind of material is used as main components of the first ink layer of the preprint ribbon and the adhesive layer of the ink ribbon (which adhesive layer adheres to the first ink layer being the topmost layer of the preprint image). The main component of the second ink layer (which adheres to the receptor upon the thermal transfer) of the preprint ribbon is preferably of the same type as the material constituting the receptor. By such a structure, it is possible to ensure the fixing ability of the preprint image to the receptor upon the thermal transfer using the preprint ribbon and the fixing ability of the ink image to the preprint image upon the thermal transfer using the ink ribbon. Thus, an image having high fastness can be obtained.

In the present invention, even if the receptor diversifies into various kinds, it is unnecessary to increase kinds of the ink ribbons each time it happens. It is sufficient only to increase kinds of the preprint ribbons. This fact is advantageous for the case that any color image is formed. As described above, for example, in the case that 4 kinds of ink ribbons in the prior art are used as ink ribbons and the number of kinds of receptors is 3, the number of kinds of necessary ink ribbons are $12=N1\times N2$. In the present invention, however, it is sufficient that $N1+N2=7$. In development of ink ribbons, their adhesive layer can be fixed to a single kind, and as a result, particularly the restriction that fixing ability to various kinds of companion materials must be considered is canceled. This is advantageous.

The following will describe the present invention in detail.

The preprint ribbon used in the present invention is a ribbon comprising, on its substrate, at least a first ink layer and a second ink layer in this order from the side of the substrate. Moreover, the main component of the first ink layer is made of the same kind of material as the main component of the adhesive layer of the ink ribbon.

As the material making the first ink layer, there can be appropriately selected and used any wax or thermoplastic resin that has been hitherto used as a binder for thermally-melting or thermally-softening ink of thermal transfer members. Preferably, the first ink layer also has a function as a release layer. From this viewpoint, materials having small adhesion to the substrate and a softening point or melting point of 60 to 140° C. are preferably used. Considering the fastness of images, the preferred main component for the first ink layer is at least one selected from the group consisting of a ketone resin (an aromatic ketone resin is especially preferable), a petroleum resin, a rosin resin, a styrene resin and a polyamide resin, each of which has a glass transition point of 60° C. or higher, and a polyethylene wax having a melting point of 100° C. or higher. The content of the main component material in the first ink layer is preferably 50% by weight or more and more preferably 70% by weight or more. In view of adjustment of adhesion to the substrate, and the like, particles as well as the above-mentioned components may be incorporated into the first ink layer. As such particles, there may be used, for example, one or more of titanium oxide, silica power, calcium carbonate, precipitated barium sulfate, magnesium carbonate, alumina and the like. The coat thickness of the first ink layer is preferably within a range of 0.1 to 20 $\mu$m and more preferably within a range of 0.1 to 5 $\mu$m. If the thickness is below the above-mentioned range, the fixing effect of the adhesive layer of the ink ribbon trends not to be obtained. On the other hand, if the thickness is over the above-mentioned range, the outer diameter of a wound roll of the preprint ribbon becomes large so that production value thereof trends to drop.

As the material for the second ink layer, there is selected a material which is of the same type as the material constituting at least the surface layer of the receptor and has good thermal transferability. In the case that the receptor is, for example, a PET film, there is preferably used a polyester resin, a polyamide resin or the like. In the case that the receptor is a PP film, a resin such as chlorinated polypropylene is preferably used. From the viewpoint of fastness of images, the weight average molecular weight of these resins is preferably 10,000 or more. Particles may be incorporated into the second ink layer in the same way as in the first ink layer. The coat thickness of the second ink layer is preferably within a range of 0.1 to 3 $\mu$m in since the balance between fixing ability and thermal sensitivity is good. If the thickness is below 0.1 $\mu$m, fixing ability trends to deteriorate. On the other hand, if the thickness is over 3 $\mu$m, thermal sensitivity trends to deteriorate.

The first and second ink layers preferably contain substantially no coloring agent so that the preprint image does not affect adversely the color of the ink image formed on the preprint image.

The ink ribbon used in the present invention is an ink ribbon comprising, on its substrate, at least a color ink layer and an adhesive layer in this order from the side of the substrate. As the main component of the adhesive layer, there is used the same kind of material as the main component of the first ink layer of the preprint ribbon. The content of the main component in the adhesive layer is preferably within the same range as for the first ink layer. The coat thickness of the adhesive layer is preferably within a range of 0.1 to 3 μm since the balance between fixing ability and thermal sensitivity is good. Concerning the ink ribbon, there are not restrictions other than these. As the color ink layer, any color ink layer for conventional thermal transfer members can be used without especial change if it comprises a coloring agent and a thermally-softening or thermally-melting binder. With respect to other constructions, constructions for conventional thermal transfer members may also be used without especial change. For example, if necessary, a release layer may be disposed between the substrate and the color ink layer. As ink ribbons for forming a color image, there are used plural ink ribbons whose color ink layers are different in color from each other. For example, yellow, magenta and cyan ink layers and, if necessary, a black ink layer are used.

As the substrates in the preprint ribbon and the ink ribbon used in the present invention, substrates used in conventional thermal transfer members may be used without especial restriction. A PET film having a thickness of about 1 to 10 μm is especially preferable from the viewpoint of heat resistance, heat conductivity and costs. It is allowable to provide, on the back surface (the surface which slide-contacts a thermal head) of the substrate, a heat-resistant, lubricative layer (stick-preventive layer), which has been hitherto known and is composed of any one of various heat-resistant resins such as a silicone resin, a silicone-modified urethane resin or a silicone-modified acrylic resin, any one of these heat-resistant resins incorporated with a lubricant, or the like.

The present invention will be described in detail by way of Examples. It is to be understood that the present invention will not be limited to these Examples, and various changes and modifications may be made in the invention without departing from the spirit and scope thereof.

EXAMPLE 1

Ink Ribbon 1

A PET film having a thickness of 4.5 μm was used as a substrate, and a silicone resin-based stick-preventive layer having a thickness of 0.2 μm was provided on one side thereof. A polyethylene wax (melting point: 110° C.) was applied onto the side of the substrate that was opposite to the stick-preventive layer by hot melt application, forming a release layer having a thickness of 0.3 μm.

The following coating liquid was applied onto the release layer and dried to form a color ink layer having a thickness of 0.7 μm.

| Component | Parts by weight |
|---|---|
| Acrylic resin(softening point: 97° C.) | 6.0 |
| Polyethylene wax | 2.0 |
| Cyanine blue | 2.0 |
| Methyl ethyl ketone | 20.0 |
| Toluene | 70.0 |

The following coating liquid was applied onto the color ink layer and dried to form an adhesive layer having a thickness of 0.5 μm.

| Component | Parts by weight |
|---|---|
| Polyamide resin (softening point: 97° C.) | 9.0 |
| Silica (average particle size: 1.0 μm) | 1.0 |
| Toluene | 18.0 |
| Isopropyl alcohol | 72.0 |

Preprint Ribbon 1

A PET film having a thickness of 4.5 μm was used as a substrate, and a silicone resin-based stick-preventive layer having a thickness of 0.2 μm was provided on one side thereof. The following coating liquid was applied onto the side of the substrate that was opposite to the stick-preventive layer and dried to form a first ink layer having a thickness of 1.5 μm.

| Component | Parts by weight |
|---|---|
| Polyamide resin (softening point: 97° C.) | 9.0 |
| Silica (average particle size: 1.0 μm) | 1.0 |
| Toluene | 18.0 |
| Isopropyl alcohol | 72.0 |

The following coating liquid was applied onto the first ink layer and dried to form a second ink layer having a thickness of 0.5 μm.

| Component | Parts by weight |
|---|---|
| Polyester resin (weight average molecular weight: 20,000) | 9.0 |
| Silica (average particle size: 1.0 μm) | 1.0 |
| Toluene | 18.0 |
| Methyl ethyl ketone | 72.0 |

The resultant preprint ribbon 1 and the ink ribbon 1 were used for printing. First, a thermal transfer using the preprint ribbon 1 was conducted onto a PET film having a thickness of 100 μm under the following print conditions. Next, a thermal transfer using the ink ribbon 1 was conducted under the following print conditions to form an image. Fastness of the resultant image was evaluated. As a result thereof, the image having high fastness was obtained.

Print Conditions

Printer: MD5000 (made by Alps Electric Co., Ltd.)

Print mode: preprint ribbon: sublimation print mode ink ribbon: Flash metallic mode Method for Evaluating Fastness The image obtained on the PET film was subjected to a rubbing test under the following conditions. When changes such as dropout portion were not observed in the image after the test, the image was evaluated as high fastness.

Rubbing Test

Test machine: Rub Tester (made by Yasuda Seiki Seisakusho Co., Ltd.)

Rubbing material: cotton cloth

Load: 250 g/cm$^2$

Number of rubbing operations: 50

EXAMPLE 2

The same ink ribbon 1 as in Example 1 was used as an ink ribbon.

The following preprint ribbon 2 was used as a preprint ribbon.

Preprint Ribbon 2

The preprint ribbon 2 was produced in the same way for forming the preprint ribbon 1 except that the second ink layer was formed using the following coating liquid.

| Component | Parts by weight |
|---|---|
| Chlorinated polypropylene (weight average molecular weight: 35,000) | 9.0 |
| Silica (average particle size: 1.0 μm) | 1.0 |
| Toluene | 45.0 |
| Methyl ethyl ketone | 45.0 |

The resultant preprint ribbon 2 and the ink ribbon 1 were used for printing. First, a thermal transfer using the preprint ribbon 2 was conducted onto a PP film having a thickness of 200 μm under the same print conditions as in Example 1. Next, a thermal transfer using the ink ribbon 1 was conducted to form an image. Fastness of the resultant image was evaluated in the same way as in Example 1. As a result thereof, the image having high fastness was obtained.

In addition to the materials and ingredients used in the Examples, other materials and ingredients can be used in the Examples as set forth in the specification to obtain substantially the same results.

As has been in detail described above, according to the thermal transfer image forming method of the present invention, a combination of a preprint ribbon and an ink ribbon is used and the preprint ribbon is allowed to cope with diversification of receptors. Therefore, even if kinds of the receptors increase, coping with the increase is easily attained and further kinds of ink ribbons can be reduced as much as possible. Moreover, an image having good fastness can be formed.

What is claimed is:

1. A thermal transfer image forming method comprising the steps of:

using a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate;

first conducting a thermal transfer using the preprint ribbon onto a receptor to form a preprint image whose topmost layer is composed of the first ink layer; and subsequently conducting a thermal transfer using the ink ribbon onto the preprint image to form an ink image, wherein the first ink layer of the preprint ribbon and the adhesive layer of the ink ribbon comprise the same kind of material as respective main components.

2. A thermal transfer image forming method comprising the steps of:

using a preprint ribbon comprising, on its substrate, at least a first ink layer and a second ink layer in this order from the side of the substrate, and plural ink ribbons each comprising, on its substrate, at least a color ink layer and an adhesive layer in this order from the side of the substrate, the color ink layers of the plural ink ribbons being different in color from each other;

first conducting a thermal transfer using the preprint ribbon onto a receptor to form a preprint image whose topmost layer is composed of the first ink layer; and subsequently conducting a thermal transfer using the plural ink ribbons onto the preprint image to form a color ink image, wherein the first ink layer of the preprint ribbon and the adhesive layer of each of the plural ink ribbons comprise the same kind of material as respective main components.

3. The thermal transfer image forming method of claim 1, wherein the same kind of material used as the main components of the first ink layer of the preprint ribbon and the adhesive layer of the ink ribbon comprises at least one selected from the group consisting of a ketone resin, a petroleum resin, a rosin resin, a styrene resin and a polyamide resin, each of which has a glass transition point of 60° C. or higher, and polyethylene wax having a melting point of 100° C. or higher.

4. The thermal transfer image forming method of claim 2, wherein the same kind of material used as the main components of the first ink layer of the preprint ribbon and the adhesive layer of each of the plural ink ribbons comprises at least one selected from the group consisting of a ketone resin, a petroleum resin, a rosin resin, a styrene resin and a polyamide resin, each of which has a glass transition point of 60° C. or higher, and polyethylene wax having a melting point of 100° C. or higher.

5. A combination of thermal transfer members comprising a preprint ribbon comprising, on its substrate, at least a first ink layer and a second ink layer in this order from the side of the substrate, and an ink ribbon comprising, on its substrate, at least a color ink layer and an adhesive layer in this order from the side of the substrate, wherein the first ink layer of the preprint ribbon and the adhesive layer of the ink ribbon comprise the same kind of material as respective main components.

6. A combination of thermal transfer members comprising a preprint ribbon comprising, on its substrate, at least a first ink layer and a second ink layer in this order from the side of the substrate, and plural ink ribbon each comprising, on its substrate, at least a color ink layer and an adhesive layer in this order from the side of the substrate, the color ink layers of the plural ink ribbons being different in color from each other, wherein the first ink layer of the preprint ribbon and the adhesive layer of each of the plural ink ribbons comprise the same kind of material as respective main components.

* * * * *